US012414631B2

(12) United States Patent
Zhang

(10) Patent No.: US 12,414,631 B2
(45) Date of Patent: Sep. 16, 2025

(54) FOLDING CHAIR

(71) Applicant: Ninghai Jiarun Hardware Co., Ltd., Zhejiang (CN)

(72) Inventor: Zhenguo Zhang, Zhejiang (CN)

(73) Assignee: Ninghai Jiarun Hardware Co., Ltd., Ningbo (CN)

( * ) Notice: Subject to any disclaimer, the term of this patent is extended or adjusted under 35 U.S.C. 154(b) by 202 days.

(21) Appl. No.: 18/232,852

(22) Filed: Aug. 11, 2023

(65) Prior Publication Data

US 2025/0031853 A1 Jan. 30, 2025

(30) Foreign Application Priority Data

Jul. 25, 2023 (CN) ..... 202321973456.7

(51) Int. Cl.
*A47C 4/28* (2006.01)
*A47C 4/30* (2006.01)
*A47C 4/48* (2006.01)

(52) U.S. Cl.
CPC ..... *A47C 4/286* (2013.01); *A47C 4/30* (2013.01); *A47C 4/48* (2013.01)

(58) Field of Classification Search
CPC .. A47C 4/286; A47C 4/30; A47C 4/48; A47C 4/02; A47C 4/44
See application file for complete search history.

(56) References Cited

U.S. PATENT DOCUMENTS 5,709,428 A * 1/1998 Hugghins ..... A47C 4/48 297/16.2
8,454,084 B2 * 6/2013 Lah ..... A47C 9/105 297/16.2
10,342,351 B2 * 7/2019 Lenhart ..... A47C 4/286
2014/0265458 A1 * 9/2014 Tseng ..... A47C 4/30 297/16.1

* cited by examiner

*Primary Examiner* — Milton Nelson, Jr.

(57) ABSTRACT

A folding chair includes a cloth cover and a support frame. The support frame includes a horizontally arranged connecting frame and a support assembly mounted on the connecting frame. The support assembly includes two mounting bases arranged at both ends of the connecting frame in an inserted manner, two support rods rotatably mounted on the mounting bases and used for supporting the cloth cover, and two support legs rotatably mounted on the mounting bases. When the folding chair spreads, the two support rods both are obliquely arranged upwards toward a direction away from the length direction of the connecting frame, and there is a first spreading included angle between the two support rods; and the two support legs both are obliquely arranged downwards toward a direction away from the length direction of the connecting frame, and there is a second spreading included angle between the two support legs.

9 Claims, 10 Drawing Sheets

FOLDING CHAIR

CROSS REFERENCE TO RELATED APPLICATIONS

The present claims the benefit of Chinese Patent Application No. 202321973456.7 filed on Jul. 25, 2023, the contents of which are incorporated herein by reference in their entirety.

TECHNICAL FIELD

This application relates to the technical field of furniture, and in particular relates to a folding chair.

BACKGROUND

A folding chair is a frequently-used tool in a family for a user to sit or lie, and it can be used as either common furniture for indoor use or a leisure product for outdoor use.

The folding chair is usually composed of a cloth cover, and a support frame for mounting the cloth cover and supporting on the ground. The support frame also includes a support rod assembly, a support leg assembly, and a mounting frame where the support rod assembly and the support leg assembly are mounted. With respect to a part of existing folding chairs, in a case that the folding chairs need to be stored after use, the support rod assembly needs to be unplugged from the mounting frame, then the cloth cover is taken down from the support rod assembly, the support leg assembly is unplugged from the mounting frame, and finally, the support rod assembly, the support leg assembly and the mounting frame are stored. Aiming at the above folding chair structure, a folding chair with a new folding pattern is provided.

SUMMARY

To make a folding chair be conveniently stored, this application provides a folding chair.

The folding chair provided by this application adopts the following technical solution:

A folding chair, including a cloth cover and a support frame, where the support frame includes a horizontally arranged connecting frame and a support assembly mounted on the connecting frame. The support assembly includes two mounting bases arranged at both ends of the connecting frame in an inserted manner, two support rods rotatably mounted on the mounting bases and used for supporting the cloth cover, and two support legs rotatably mounted on the mounting bases and supported on the ground. When the folding chair spreads, the two support rods both are obliquely arranged upwards toward a direction away from the length direction of the connecting frame, and there is a first spreading included angle between the two support rods; and the two support legs both are obliquely arranged downwards toward a direction away from the length direction of the connecting frame, and there is a second spreading included angle between the two support legs.

By adopting the above technical solution, when the folding chair is stored, the support rods are rotated to a folded state, so that the support rods are turned from a spread state into the folded state, and then the support legs are rotated, so that the support legs are turned from the spread state into the folded state. When the above folding chair is stored, it is unnecessary to detach the support rods and the support legs, and the folding chair is stored by way of rotation, so the storage process is simple and convenient.

Optionally, each of the mounting bases includes a first rotating base where each of the support legs is mounted and a second rotating base where each of the support rods is mounted; the first rotating base is provided with a first rotating groove, and a first rotating shaft is arranged in the first rotating groove; and the second rotating base is provided with a second rotating groove, and a second rotating shaft is arranged in the second rotating groove.

By adopting the above technical solution, a structural form of the mounting base is specifically disclosed. The mounting base is inserted onto the connecting rod, the support leg is mounted on the first rotating base and is capable of rotating on the first rotating base, and the support rod is mounted on the second rotating base and is capable of rotating on the second rotating base. The mounting base features simple structure. The way to mount the support leg and the support rod on the connecting rod is simple and convenient.

Optionally, the first rotating base and the second rotating base are integrally connected.

By adopting the above technical solution, a second structural form of the mounting base is specifically disclosed. The first rotating base and the second rotating base are integrally arranged and are integrally inserted onto the connecting rod, and the support leg and the support rod both are rotatably connected to the mounting base. By using the above mounting base, the number of parts of the folding chair decreases, so the mounting process of the folding chair is simplified.

Optionally, the support assembly further includes a first locking assembly used for limiting the support leg in the first rotating base, so that the support leg has a folded position and a spread position; the first locking assembly includes a first sliding block slidably mounted in the length direction of the support leg, a first locking column mounted on the first sliding block and perpendicular to the sliding direction of the first sliding block, and a first locking spring mounted on the support leg; the first rotating groove is internally provided with a first locking groove and a second locking groove; when the support leg is located at the folded position, the first locking spring drives the first locking column to be clamped to the first locking groove all along; and when the support leg is located at the spread position, the first locking spring drives the first locking column to be clamped to the second locking groove all along.

By adopting the above technical solution, a structural form of the first locking assembly is specifically disclosed. By sliding the first sliding block, the first sliding block overcomes the elastic force of the first locking spring, so that the first locking column on the first sliding block is capable of respectively locking the first locking groove and the second locking groove. When the first locking column is located in the first locking groove, the support leg is located at the folded position, and when the first locking column is located in the second locking groove, the support leg is located at the spread position.

Optionally, the support leg is a hollow metal tube; the first sliding block and the first locking spring both are located in an inner cavity of the support leg; the first locking assembly further comprises a first sliding sleeve sleeved over the outer side of the support leg and capable of sliding in the length direction of the support leg, a first connecting rod arranged on the support leg in a penetrating manner for connecting the first sliding sleeve and the first sliding block, and a first fixed block mounted in the inner cavity of the support leg for abutting against the first locking spring; and the support leg is provided in the length direction with a first strip-type groove where the first connecting rod slides and a first sliding groove where the first locking column slides.

By adopting the above technical solution, the first sliding block and the first locking spring both are arranged in the inner cavity of the support leg, and the first sliding sleeve is arranged on the outer side of the support leg to drive the first sliding block to slide in the support leg, so that the first sliding block and the first locking spring hardly escape from the support leg when the folding chair is used. As the first locking spring is located in the inner cavity of the support leg, the first locking spring is not susceptible to damage.

Optionally, the first rotating shaft penetrates through the first sliding block; and the first sliding block is provided in the length direction with a first strip-type through hole where the first rotating shaft slides.

By adopting the above technical solution, the first sliding block is arranged on the outer side of the first rotating shaft in a penetrating manner. When the folding chair is used, further, the first sliding block hardly escapes from the support leg.

Optionally, the support rod includes a front support rod located at the front end of the cloth cover and a rear support rod located at the rear end of the cloth cover; the front support rod is an integrated rod; the rear support rod is a telescopic rod having an elongated state and a contracted state; the rear support rod includes at least two telescopic units; and a locking structure for locking the rear support rod in the elongated state is arranged between adjacent telescopic units.

By adopting the above technical solution, the rear support rod of the support rod is in the structural form of the telescopic rod. When the folding chair is stored, the rear support rod is turned from the elongated state into the contracted state first, so the cloth cover is capable of being turned from a tightened state into a loosened state. According to the structure of the support rod, the operating process of storing the folding chair is simple and convenient.

Optionally, the locking structure includes an elastic pressing sheet arranged in one of the telescopic units, an elastic column connected to the elastic pressing sheet and arranged in the telescopic unit in a penetrating manner, and a locking through hole formed in the other telescopic unit, the elastic column penetrating through the locking through hole.

By adopting the above technical solution, a form of the locking structure is specifically disclosed. When the rear support rod needs to be contracted, the elastic column is pressed, so that the elastic pressing sheet deforms. The elastic column retreats from the locking through hole, and in this case, the telescopic units are capable of stretching. The locking structure is simply and conveniently operated.

Optionally, the angle of the first spreading included angle is 90°-120°.

By adopting the above technical solution, when the angle of the first spreading included angle is 90°-120°, the support rods are capable of unfolding the cloth cover completely, and the cloth cover is in the tightened state. When the user sits on the folding chair, the orientation angle of the cloth cover is in line with the most comfortable state of a human body.

Optionally, the angle of the second spreading included angle is 70°-90°.

By adopting the above technical solution, when the second spreading included angle is 70°-90°, the structural strength of the support legs is higher, and the support legs are capable of supporting the folding chair.

In conclusion, this application includes at least one beneficial technical effect below:

1. According to a folding chair, by rotating the support rod and the support leg, the folding chair is switched between the spread state and the stored state in a reciprocating manner; and when the above folding chair is stored, it is unnecessary to detach the support rod and the support leg, so the storage process of the folding chair is simple and convenient.
2. The support leg is rotatably arranged on the mounting base and has the spread position and the folded position; and by arranging the first locking assembly, the support leg is capable of being locked in the spread state or the folded state, and is difficult to change.
3. By designing the rear support rod in the structural form of the telescopic rod, when the folding chair is stored, the cloth cover is capable of being turned from the tightened state into the loosened state; and thanks to the structure of the rear support rod, the folding chair is simply and conveniently stored.

Figure 1:
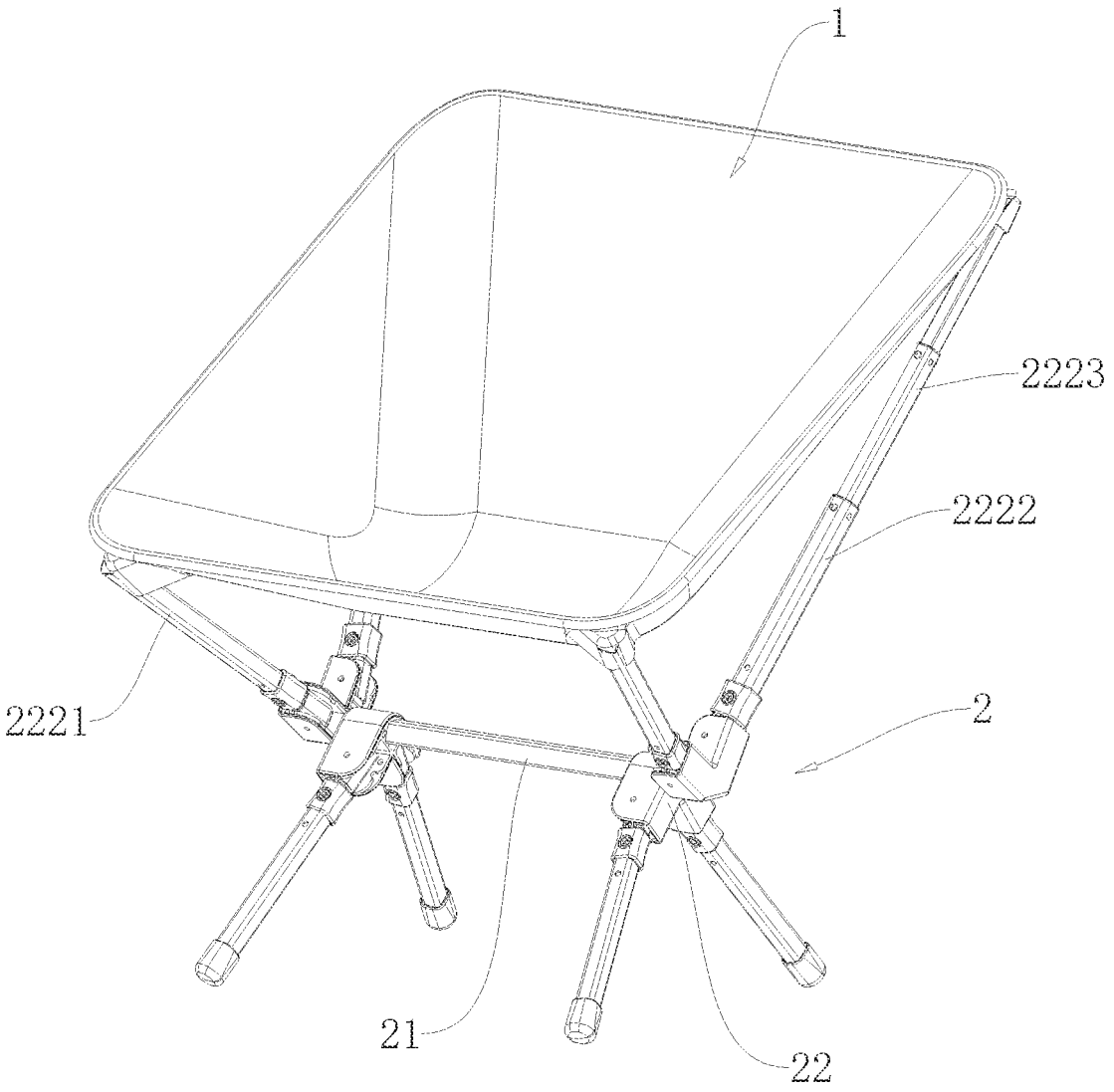
FIG. 1 is a schematic diagram of an overall structure of a folding chair in the Embodiment 1 of this application.

Description of numerals in the drawings: 1, cloth cover; 2, support frame; 21, connecting frame; 22, support assembly; 221, mounting base; 2211, first rotating base; 2212, second rotating base; 2213, first rotating groove; 2214, second rotating groove; 2215, first locking groove; 2216, second locking groove; 2217, third locking groove; 2218, fourth locking groove; 222, support rod; 2221, front support rod; 2222, rear support rod; 2223, telescopic unit; 2224, elastic pressing sheet; 2225, elastic column; 2226, locking through hole; 2227, second rotating shaft; 2228, second sliding groove; 2229, second strip-type groove; 223, support leg; 2231, first sliding groove; 2232, first strip-type groove; 2233, first rotating shaft; 224, first locking assembly; 2241, first sliding block; 2242, first locking column; 2243, first locking spring; 2244, first fixed block; 2245, first connecting rod; 2246, first sliding sleeve; 2247, first strip-type through hole; 225, second locking assembly; 2251, second sliding block; 2252, second locking column; 2253, second locking spring; 2254, second fixed block; 2255, second connecting rod; 2256, second sliding sleeve; 2257, second strip-type through hole; 226, first spreading included angle; and 227, second spreading included angle.

DETAILED DESCRIPTION

This application will be further described in detail below in conjunction with FIGS. 1-10. Embodiments of this application disclose a folding chair.

Embodiment 1

Referring to FIG. 1, a folding chair includes a cloth cover 1 and a support frame 2. The support frame 2 includes a connecting frame 21 and support assemblies 22 mounted on the connecting frame 21. The connecting frame 21 is a square long rod. The support assemblies 22 are capable of being used for mounting the cloth cover 1 and are capable of being supported on the ground. The cloth cover 1 is fixedly connected to the support assemblies 22 through screws.

Figure 2:
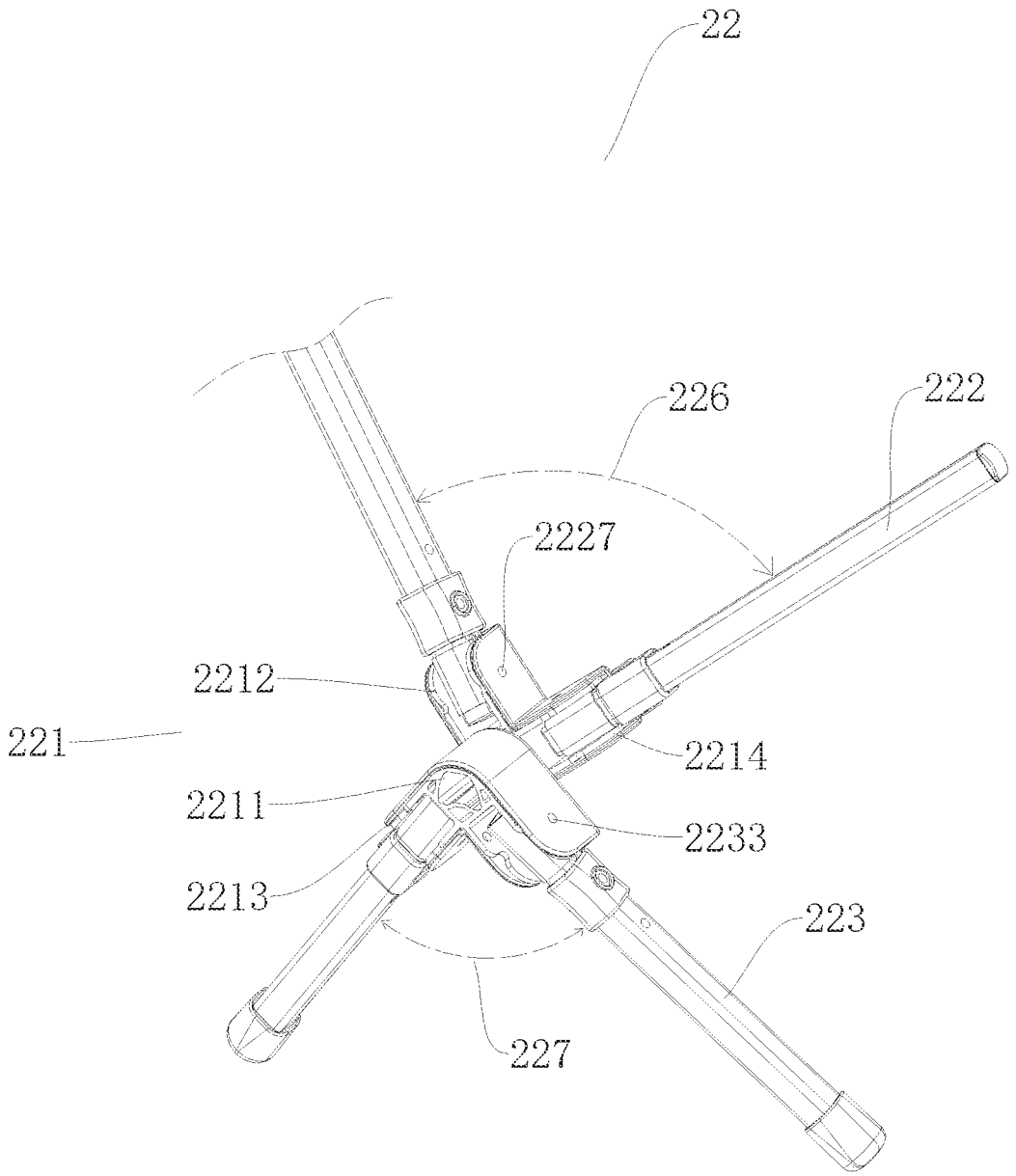
FIG. 2 is a schematic structural diagram of a support assembly in the Embodiment 1 of this application.

Referring to FIG. 1 and FIG. 2, there are two support assemblies 22 respectively mounted at both ends of the connecting frame 21. Each of the support assemblies 22 includes a mounting base 221, a support rod 222 for mounting the cloth cover 1, and a support leg 223 capable of being supported on the ground. The mounting base 221 is arranged on the connecting frame 21 in a penetrating manner. The support rod 222 and the support leg 223 both are rotatably arranged on the mounting base 221. In this embodiment, the mounting base 221 includes a first rotating base 2211 and a second rotating base 2212. The first rotating base 2211 and the second rotating base 2212 both are arranged on the connecting frame 21 in a penetrating manner, and the first rotating base 2211 is located on the inner side of the second rotating base 2212. The first rotating base 2211 is C-shaped, first rotating grooves 2213 are formed at two corners of the first rotating base 2211, and a first rotating shaft 2233 is arranged in each of the first rotating grooves 2213. The support leg 223 is rotatably arranged in the first rotating groove 2213, and the first rotating shaft 2233 penetrates through the support leg 223, so that the support leg 223 is capable of rotating by taking the first rotating shaft 2233 as a rotating center, and the support leg 223 has a folded position and a spread position. The second rotating base 2212 is C-shaped, second rotating grooves 2214 are formed at two corners of the second rotating base 2212, and a second rotating shaft 2227 is arranged in each of the second rotating grooves 2214. The support rod 222 is rotatably arranged in the second rotating groove 2214, and the second rotating shaft 2227 penetrates through the support rod 222, so that the support rod 222 is capable of rotating by taking the second rotating shaft 2227 as a rotating center, and the support rod 222 has the folded position and the spread position.

Figure 3:
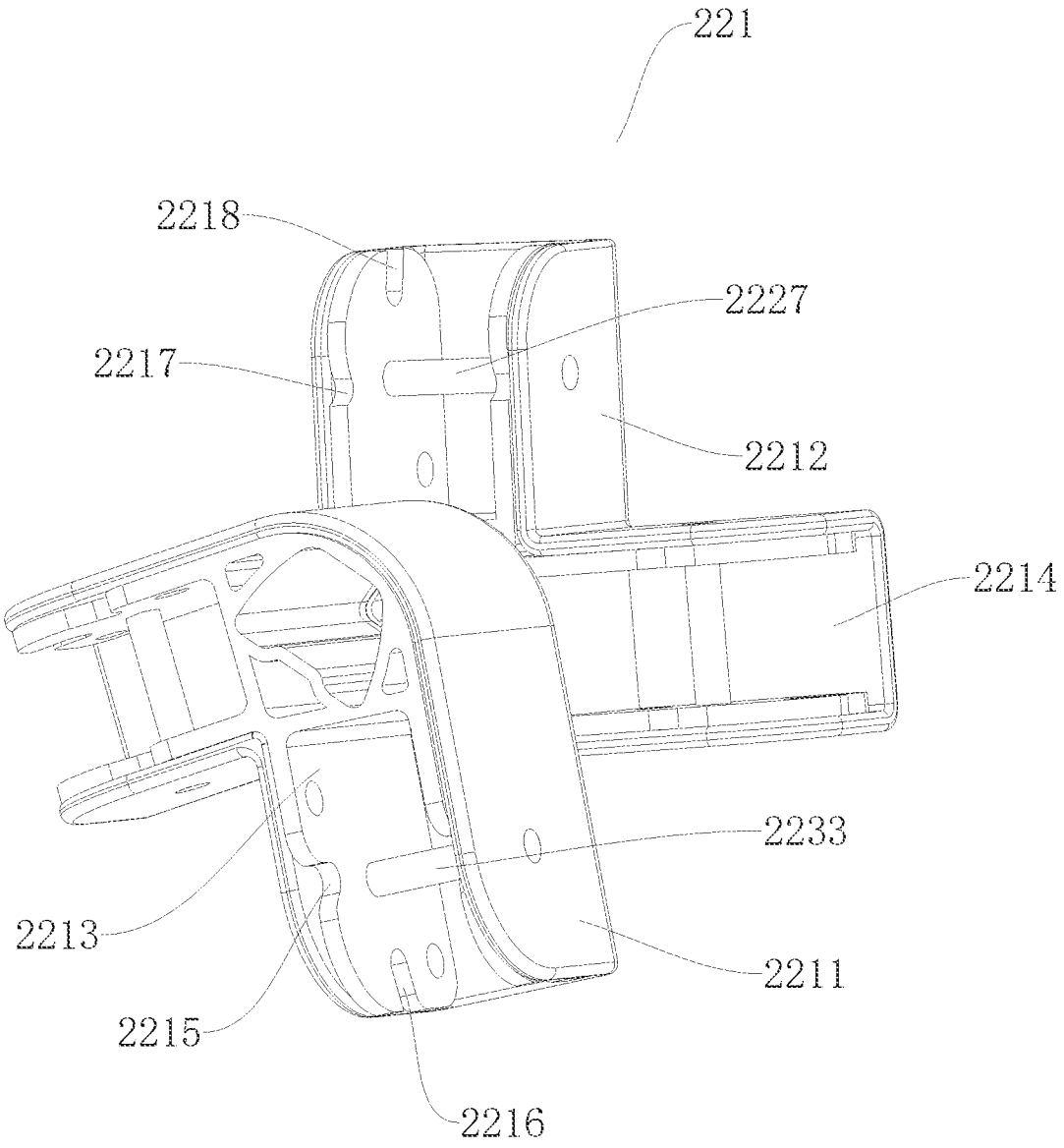
FIG. 3 is a schematic structural diagram of a mounting base in the Embodiment 1 of this application.
Figure 4:
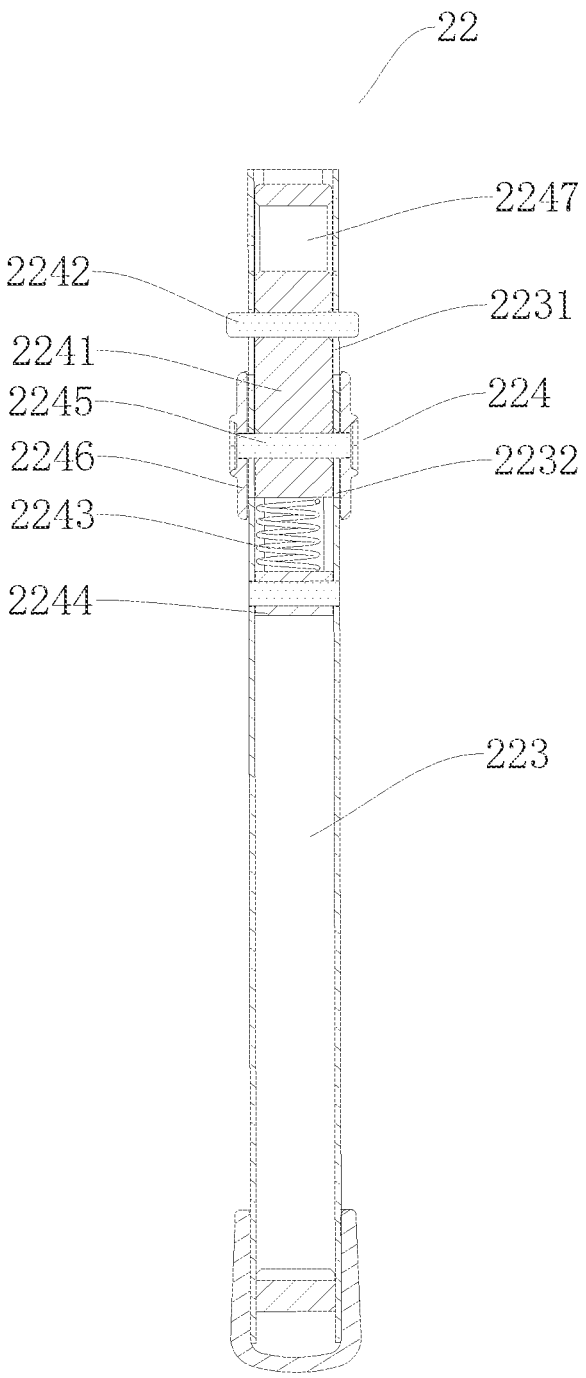
FIG. 4 is a sectional view of a first locking assembly of a support leg in the Embodiment 1 of this application.

Referring to FIG. 3 and FIG. 4, the support assembly 22 further includes a first locking assembly 224 which limits the support leg 223 in the first rotating groove 2213. The first locking assembly 224 includes a first sliding block 2241, a first locking column 2242, a first locking spring 2243, a first fixed block 2244, a first connecting rod 2245, and a first sliding sleeve 2246. The support leg 223 is a square metal tube provided with a hollow inner cavity. The first sliding block 2241 is a cuboid block matched with the inner wall of the support leg 223, and the first sliding block 2241 is slidably mounted in an inner cavity of the support leg 223 in the length direction of the support leg 223. Moreover, the first sliding block 2241 is sleeved over the outer side of the first rotating shaft 2233, and the first sliding block 2241 is provided with a first strip-type through hole 2247 where the first rotating shaft 2233 slides in the length direction. The first fixed block 2244 is fixed in the inner cavity of the support leg 223, and is located on the side, away from the mounting base 221, in the first sliding block 2241. The first locking spring 2243 is arranged in the inner cavity of the support leg 223, and one end of the first locking spring 2243 abuts against the first sliding block 2241 and the other end thereof abuts against the first fixed block 2244. The first locking spring 2243 drives the first sliding block 2241 to have a tendency to slide toward the direction of the mounting base 221 all along.

Referring to FIG. 3 and FIG. 4, a first locking column 2242 is arranged on the first sliding block 2241 in a penetrating manner, and both ends of the first locking column 2242 penetrate through the support leg 223 and stretch out of the support leg 223. The support leg 223 is provided with a first sliding groove 2231 where the first locking column 2242 slides in the length direction. A first locking groove 2215 and a second locking groove 2216 where the first locking column 2242 is slidably clamped are formed in the inner wall of a first rotating groove 2213. When the support leg 223 is located at the folded position, the first locking column 2242 driven by the first locking spring 2243 is clamped in the first locking groove 2215 all along. When the support leg 223 is located at the spread position, the first locking column 2242 driven by the first locking spring 2243 is clamped in the second locking groove 2216 all along.

Referring to FIG. 3 and FIG. 4, the first sliding sleeve 2246 is a square sleeve, and is arranged on the outer side of the support leg 223 in a sleeved manner, and is capable of sliding on the support leg 223 in the length direction of the support leg 223. A first connecting rod 2245 penetrates through the first sliding sleeve 2246, the support leg 223 and the first sliding block 2241, so that the first sliding sleeve 2246 and the first sliding block 2241 are connected together. When the first sliding sleeve 2246 slides on the support leg 223, the first sliding block 2241 is capable of sliding synchronously. The support leg 223 is provided with a first strip-type groove 2232 where the first connecting rod 2245 slides in the length direction.

Referring to FIG. 3 and FIG. 4, by driving the first sliding sleeve 2246 to slide on the support leg 223, the first locking column 2242 is capable of overcoming the elastic force of the first locking spring 2243 and escaping from the first locking groove 2215 or the second locking groove 2216, so as to unlock the first locking assembly 224, so that the support leg 223 is capable of being switched between the folded position and the spread position.

Figure 5:
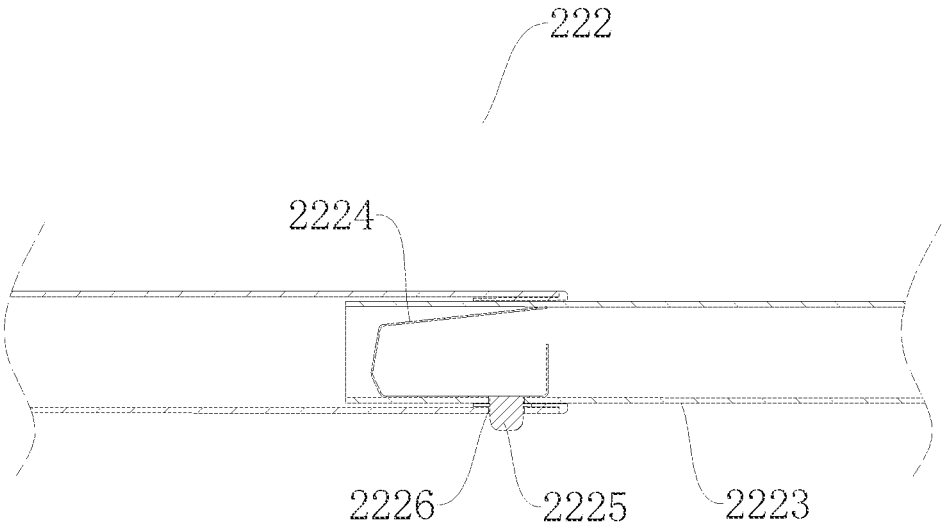
FIG. 5 is a sectional view of a locking structure in a support rod in the Embodiment 1 of this application.

Referring to FIG. 1 and FIG. 5, the support rod 222 is a hollow square metal tube used for mounting the cloth cover 1. Each of the support rods 222 includes a front support rod 2221 located at the front end of the cloth cover 1 and a rear support rod 2222 located at the rear end of the cloth cover 1. The front support rod 2221 is an integral metal rod with fixed length. The rear support rod 2222 is a telescopic rod having an elongated state and a contracted state. In this embodiment, the telescopic rod includes three telescopic units 2223, and a locking structure for locking the telescopic rod in the elongated state is arranged between adjacent telescopic units 2223. The locking structure includes an elastic pressing sheet 2224 arranged in an end portion of one of the telescopic units 2223, an elastic column 2225 connected to the elastic pressing sheet 2224 and arranged in the telescopic unit 2223 in a penetrating manner, and a locking through hole 2226 formed in an end portion of the adjacent telescopic unit 2223, and the clastic column 2225 penetrates through the locking through hole. The locking column is a cylindrical which is in welded connection to the elastic pressing sheet 2224 integrally. The elastic column 2225 stretches out of the telescopic unit 2223 all along under the elastic force of the elastic pressing sheet 2224 and penetrates through the adjacent telescopic unit 2223, so that the two adjacent telescopic units 2223 are locked in the elongated state. When the telescopic rod needs to be contracted, the elastic column 2225 is pressed, and the clastic column 2225 overcomes the elastic force of the elastic pressing sheet 2224 and contracts into the telescopic unit 2223, so that the adjacent telescopic units 2223 are capable of sliding, and the telescopic rod is capable of returning to the contracted state from the elongated state. By arranging the rear support rod 2222 as the telescopic rod, when the folding chair is stored, the rear support rod 2222 is turned from the elongated state into the contracted state, so that the cloth cover 1 is capable of being turned from the tightened state into the loosened state. Therefore, it is convenient to store the folding chair.

Figure 6:
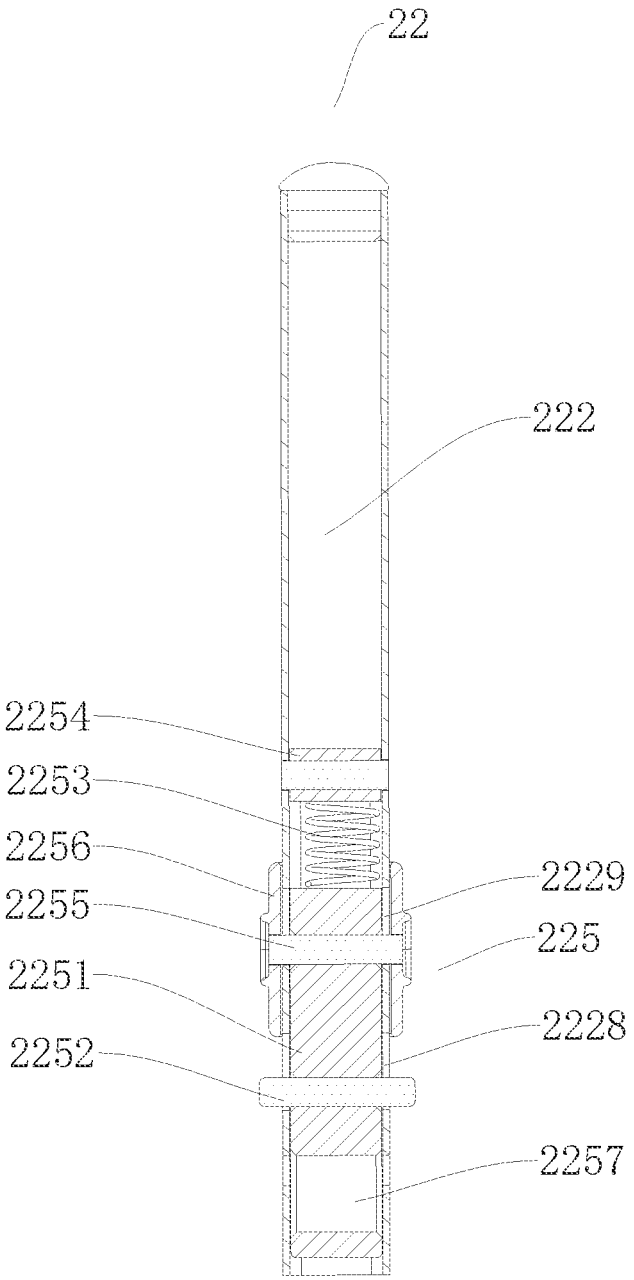
FIG. 6 is a sectional view of a second locking assembly in the support rod in the Embodiment 1 of this application.

Referring to FIG. 3 and FIG. 6, the support assembly 22 further includes a second locking assembly 225 which limits the support rod 222 in the second rotating groove 2214. The second locking assembly 225 includes a second sliding block 2251, a second locking column 2252, a second locking spring 2253, a second fixed block 2254, a second connecting rod 2255, and a second sliding sleeve 2256. The second sliding block 2251 is a cuboid block matched with the inner wall of the support rod 222, and the second sliding block 2251 is slidably mounted in the inner cavity of the support rod 222 in the length direction of the support rod 222. Moreover, the second sliding block 2251 is sleeved over the outer side of the second rotating shaft 2227, and the second sliding block 2251 is provided with a second strip-type through hole 2257 where the second rotating shaft 2227 slides in the length direction. The second fixed block 2254 is fixed in the inner cavity of the support rod 222, and is located on the side, away from the mounting base 221, in the second sliding block 2251. The second locking spring 2253 is arranged in the inner cavity of the support rod 222, and one end of the second locking spring 2253 abuts against the second sliding block 2251 and the other end thereof abuts against the second fixed block 2254. The second locking spring 2253 drives the second sliding block 2251 to have a tendency to slide toward the direction of the mounting base 221 all along.

Referring to FIG. 3 and FIG. 6, a second locking column 2252 is arranged on the second sliding block 2251 in a penetrating manner, and both ends of the second locking column 2252 penetrate through the support rod 222 and stretch out of the support rod 222. The support rod 222 is provided with a second sliding groove 2228 where the second locking column 2252 slides in the length direction. A third locking groove 2217 and a fourth locking groove 2218 where the second locking column 2252 is slidably clamped are formed in the inner wall of a second rotating groove 2214. When the support rod 222 is located at the folded position, the second locking column 2252 driven by the second locking spring 2253 is clamped in the third locking groove 2217 all along. When the support rod 222 is located at the spread position, the second locking column 2252 driven by the second locking spring 2253 is clamped in the fourth locking groove 2218 all along.

Referring to FIG. 3 and FIG. 6, the second sliding sleeve 2256 is a square sleeve, and is arranged on the outer side of the support rod 222 in a sleeved manner, and is capable of sliding on the support rod 222 in the length direction of the support rod 222. A second connecting rod 2255 penetrates through the second sliding sleeve 2256, the support rod 222 and the second sliding block 2251, so that the second sliding sleeve 2256 and the second sliding block 2251 are connected together. When the second sliding sleeve 2256 slides on the support rod 222, the second sliding block 2251 is capable of sliding synchronously. The support rod 222 is provided with a second strip-type groove 2229 where the second connecting rod 2255 slides in the length direction.

Referring to FIG. 3 and FIG. 6, by driving the second sliding sleeve 2256 to slide on the support rod 222, the second locking column 2252 is capable of overcoming the elastic force of the second locking spring 2253 and escaping from the third locking groove 2217 or the fourth locking groove 2218, so as to unlock the second locking assembly 225, so that the support rod 222 is capable of being switched between the folded position and the spread position.

Referring to FIG. 1 and FIG. 2, when the folding chair spreads, the two support rods 222 in the support assembly 22 both are obliquely arranged upwards toward a direction away from the length direction of the connecting frame 21, and there is a first spreading included angle 226 between the two support rods 222. The angle of the first spreading included angle 226 is 90°-120°, preferably 90° here, so that the support rods 222 are capable of unfolding the cloth cover 1 completely, and the cloth cover is in a tightened state. When the user sits on the folding chair, the orientation angle of the cloth cover 1 is in line with the most comfortable angular posture of a human body. The two support legs 223 in the support assembly 22 both are obliquely arranged downwards toward a direction away from the length direction of the connecting frame 21, and there is a second spreading included angle 227 between the two support legs 223. The angle of the second spreading included angle 227 is 70°-90°, preferably 85° here, so that the structural strength of the support legs 223 is higher, and the support legs 223 are capable of supporting the folding chair.

Figure 7:
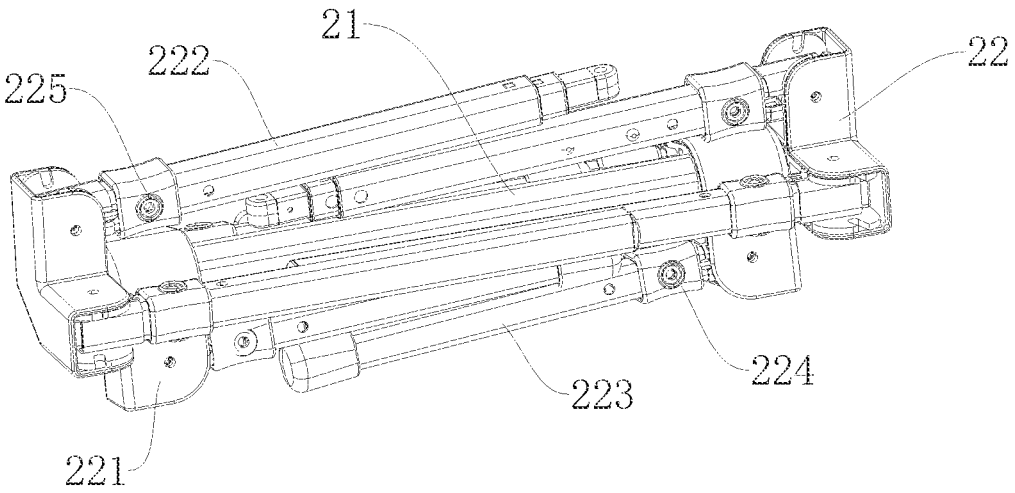
FIG. 7 is a schematic structural diagram of a stored state of a folding chair in the Embodiment 1 of this application.

Referring to FIG. 7, when the folding chair is stored, the first locking assembly 224 is unlocked, so that the support legs 223 are turned from the spread position into the folded position, and the support legs 223 are closely contacted with the connecting frame 21. The second locking assembly 225 is unlocked, so that the support rods 222 are turned from the spread position into the folded position, and the support rods 222 are closely contacted with the connecting frame 21. The folding chair features small overall volume after being folded.

In conjunction of FIG. 1 to FIG. 7, the steps of storing the folding chair in the Embodiment 1 of this application are as follows:

1. The rear support rod 2222 is contracted, so that the cloth cover 1 is turned from the tightened state into the loosened state;
2. The support rods 222 are rotated to the folded position, and in this case, the support rods 222 are closely contacted with the connecting frame 21; and
3. The support legs 223 are rotated to the folded position, and in this case, the support legs 223 are closely contacted with the connecting frame 21, so that the folding chair is stored.

Embodiment 2

Compared with the Embodiment 1, except for the structure of the mounting base 221, other structures of a folding chair in the Embodiment 2 are identical to those in the Embodiment 1.

Figure 8:
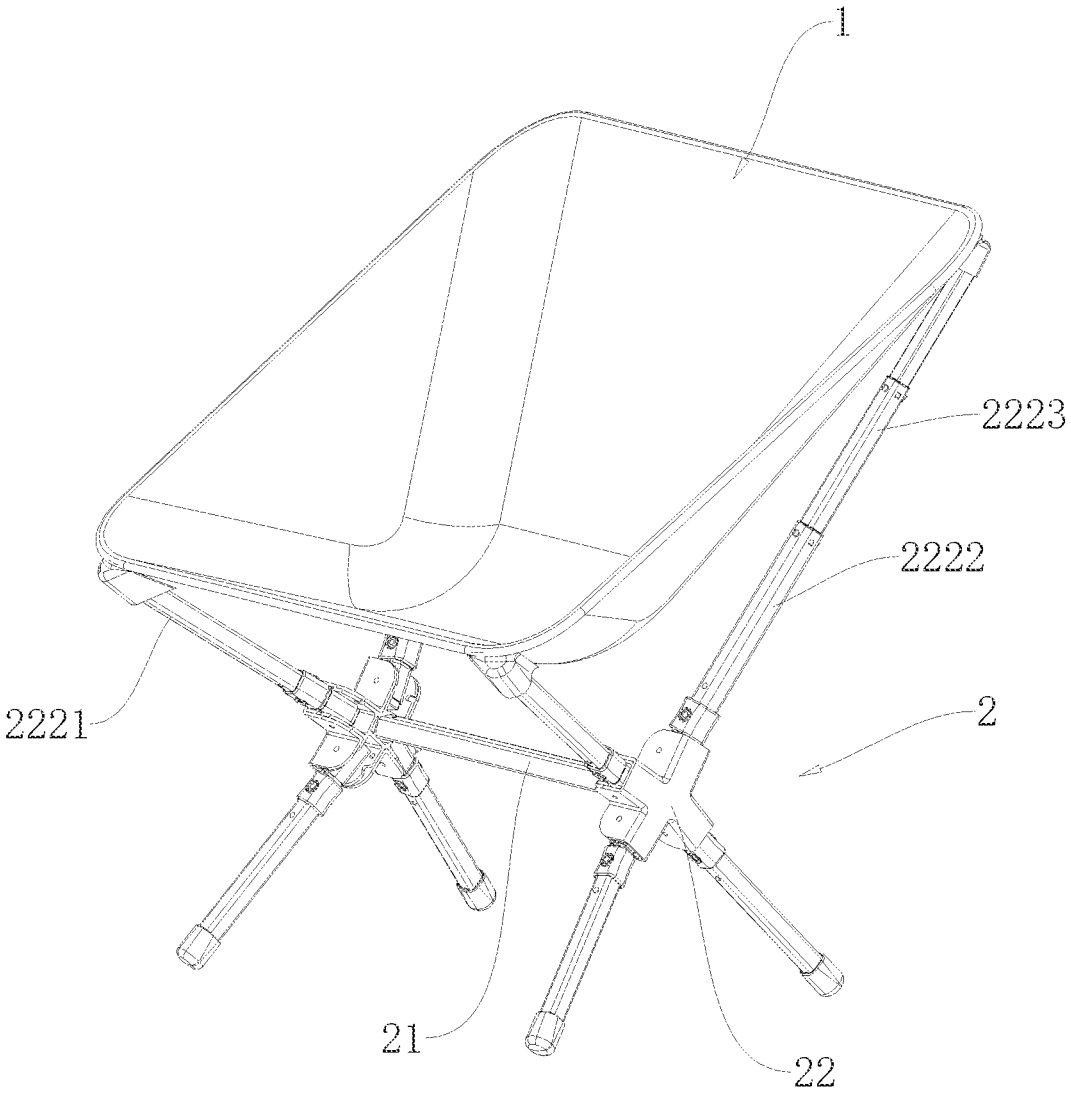
FIG. 8 is a schematic diagram of an overall structure of a folding chair in the Embodiment 2 of this application.
Figure 9:
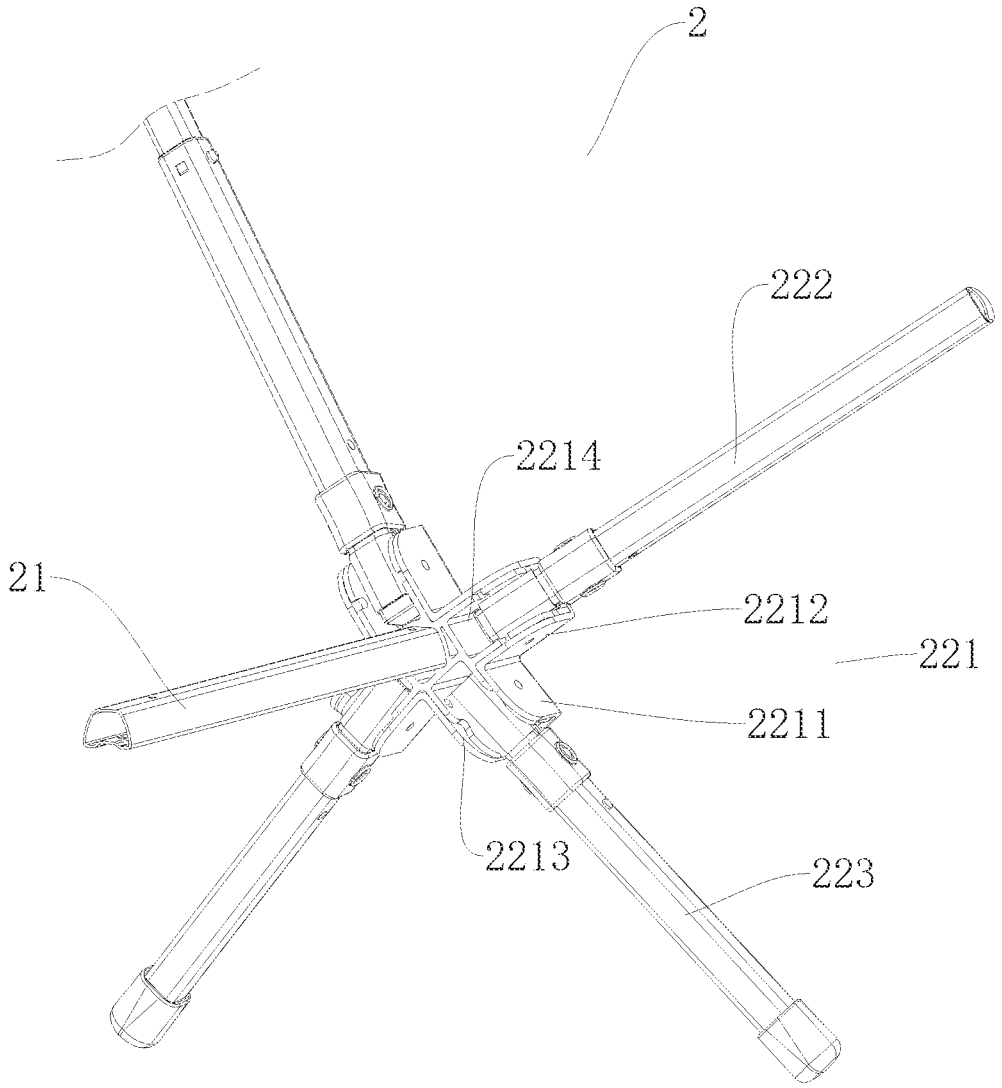
FIG. 9 is a schematic structural diagram of a support assembly of a folding chair in the Embodiment 2 of this application.

Referring to FIG. 8 and FIG. 9, in this embodiment, the mounting base 221 includes a first rotating base 2211 and a second rotating base 2212, and the first rotating base 2211 and the second rotating base 2212 are integrally connected, so that the mounting base 221 is integrally X-shaped. The mounting bases 221 are arranged at both ends of the connecting frame 21 in a penetrating manner. First rotating grooves 2213 and second rotating grooves 2214 are formed at four corners of each of the mounting bases 221. The first rotating grooves 2213 are formed at two corners of the lower end in the mounting base 221, and the second rotating grooves 2214 are formed at two corners of the upper end in the mounting base 221.

Figure 10:
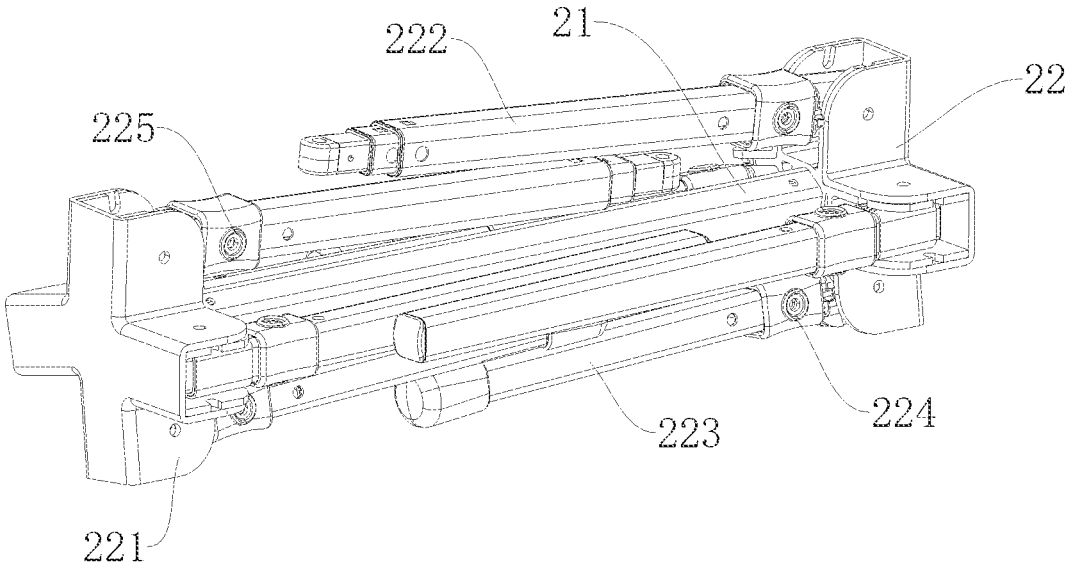
FIG. 10 is a schematic structural diagram of a stored state of a folding chair in the Embodiment 2 of this application.

Referring to FIG. 10, when the folding chair is stored, the first locking assembly 224 is unlocked, so that the support legs 223 are turned from the spread position into the folded position, and the support legs 223 are closely contacted with the connecting frame 21. The second locking assembly 225 is unlocked, so that the support rods 222 are turned from the spread position into the folded position, and the support rods 222 are closely contacted with the connecting frame 21. The folding chair features small overall volume after being folded.

What are described above are all preferred embodiments of this application, and are not intended to limit the scope of the protection of this application. Therefore, equivalent changes made according to the structure, shape and principle of this application should all fall within the scope of the protection of this application.

What is claimed is:

1. A folding chair, comprising a cloth cover (1) and a support frame (2), wherein the support frame (2) comprises a horizontally arranged connecting frame (21) and a support assembly (22) mounted on the connecting frame (21); the support assembly (22) comprises two mounting bases (221) arranged at both ends of the connecting frame (21) in an inserted manner;

for each mounting base (221), two support rods (222) rotatably mounted on the mounting base (221) and used for supporting the cloth cover (1), and two support legs (223) rotatably mounted on the mounting base (221) and supported on the ground; when the folding chair spreads, the two support rods (222) both are arranged at an oblique angle upwards relative to a vertical direction and extend away from a length direction of the connecting frame (21), and there is a first spreading included angle (226) between the two support rods (222); and the two support legs (223) both are arranged at an oblique angle downwards relative to the vertical direction and extend away from the length direction of the connecting frame (21), and there is a second spreading included angle (227) between the two support legs (223);

wherein each of the mounting bases (221) comprises a first rotating base (2211) where each of the two support legs (223) is mounted and a second rotating base (2212) where each of the two support rods (222) is mounted; the first rotating base (2211) is provided with a first rotating groove (2213), and a first rotating shaft (2233) is arranged in the first rotating groove (2213); and the second rotating base (2212) is provided with a second rotating groove (2214), and a second rotating shaft (2227) is arranged in the second rotating groove (2214).

2. The folding chair according to claim 1, wherein an angle of the second spreading included angle (227) is 70°-90°.

3. The folding chair according to claim 1, wherein the first rotating base (2211) and the second rotating base (2212) are integrally connected and arranged.

4. The folding chair according to claim 3, wherein the support assembly (22) further comprises a first locking assembly (224) used for limiting each support leg (223) in the first rotating base (2211), so that the support leg (223) has a folded position and a spread position;

the first locking assembly (224) comprises a first sliding block (2241) slidably mounted in a length direction of the support leg (223), a first locking column (2242) mounted on the first sliding block (2241) and perpendicular to a sliding direction of the first sliding block (2241), and a first locking spring (2243) mounted on the support leg (223); the first rotating groove (2213) is internally provided with a first locking groove (2215) and a second locking groove (2216); when the support leg (223) is located at the folded position, the first locking spring (2243) drives the first locking column (2242) to be clamped to the first locking groove (2215) all along; and when the support leg (223) is located at the spread position, the first locking spring (2243) drives the first locking column (2242) to be clamped to the second locking groove (2216) all along.

5. The folding chair according to claim 4, wherein the support leg (223) is a hollow metal tube; the first sliding block (2241) and the first locking spring (2243) both are located in an inner cavity of the support leg (223); the first locking assembly (224) further comprises a first sliding sleeve (2246) sleeved over an outer side of the support leg (223) and capable of sliding in the length direction of the support leg (223), a first connecting rod (2245) arranged on the support leg (223) in a penetrating manner for connecting the first sliding sleeve (2246) and the first sliding block (2241), and a first fixed block (2244) mounted in the inner cavity of the support leg (223) for abutting against the first locking spring (2243); and the support leg (223) is provided in the length direction thereof with a first strip-type groove (2232) where the first connecting rod (2245) slides and a first sliding groove (2231) where the first locking column (2242) slides.

6. The folding chair according to claim 5, wherein the first rotating shaft (2233) penetrates through the first sliding block (2241); and the first sliding block (2241) is provided in a length direction thereof with a first strip-type through hole (2247) where the first rotating shaft (2233) slides.

7. The folding chair according to claim 1, wherein an angle of the first spreading included angle (226) is 90°-120°.

8. A folding chair, comprising a cloth cover (1) and a support frame (2), wherein the support frame (2) comprises a horizontally arranged connecting frame (21) and a support assembly (22) mounted on the connecting frame (21); the support assembly (22) comprises two mounting bases (221) arranged at both ends of the connecting frame (21) in an inserted manner;

for each mounting base (221), two support rods (222) rotatably mounted on the mounting base (221) and used for supporting the cloth cover (1), and two support legs (223) rotatably mounted on the mounting base (221) and supported on the ground; when the folding chair spreads, the two support rods (222) both are arranged at an oblique angle upwards relative to a vertical direction and extend away from a length direction of the connecting frame (21), and there is a first spreading included angle (226) between the two support rods (222); and the two support legs (223) both are arranged at an oblique angle downwards relative to the vertical direction and extend away from the length direction of the connecting frame (21), and there is a second spreading included angle (227) between the two support legs (223), wherein each support rod (222) comprises a front support rod (2221) located at a front end of the cloth cover (1) and a rear support rod (2222) located at a rear end of the cloth cover (1); the front support rod (2221) is an integrated rod; the rear support rod (2222) is a telescopic rod having an elongated state and a contracted state; the rear support rod (2222) comprises at least two telescopic units (2223); and a locking structure for locking the rear support rod (2222) in the elongated state is arranged between adjacent telescopic units (2223).

9. The folding chair according to claim 8, wherein the locking structure comprises an elastic pressing sheet (2224) arranged in one of the telescopic units (2223), an elastic column (2225) connected to the elastic pressing sheet (2224) and arranged in the one of the telescopic units (2223) in a penetrating manner, and a locking through hole (2226) formed in another telescopic unit (2223), the elastic column (2225) penetrating through the locking through hole.

* * * * *